US005699934A

United States Patent [19]

Kolcun et al.

[11] Patent Number: 5,699,934

[45] Date of Patent: Dec. 23, 1997

[54] DISPENSER AND METHOD FOR DISPENSING VISCOUS FLUIDS

[75] Inventors: Joseph F. Kolcun, Binghamton; Stanley W. Janisiewicz, Endwell; Koenraad A. Gieskes, Binghamton, all of N.Y.

[73] Assignee: Universal Instruments Corporation, Binghamton, N.Y.

[21] Appl. No.: 593,466

[22] Filed: Jan. 29, 1996

[51] Int. Cl.[6] ..... B67B 7/00

[52] U.S. Cl. ..... 222/1; 222/61; 222/386.5

[58] Field of Search ..... 222/1, 61, 309, 222/386.5, 389, 214, 14

[56] References Cited

U.S. PATENT DOCUMENTS

| | | | |
|---|---|---|---|
| 2,107,564 | 2/1938 | Dickey . | |
| 2,121,549 | 6/1938 | McNeal . | |
| 2,346,879 | 4/1944 | Turzillo . | |
| 2,529,028 | 11/1950 | Landon . | |
| 2,549,231 | 4/1951 | Perkins . | |
| 2,664,226 | 12/1953 | Gobin . | |
| 2,920,573 | 1/1960 | Schaurte . | |
| 3,298,320 | 1/1967 | Latham, Jr. . | |
| 3,794,222 | 2/1974 | Loewenthal . | |
| 3,828,985 | 8/1974 | Schindler . | |
| 3,844,446 | 10/1974 | Solt | 222/61 X |
| 4,494,912 | 1/1985 | Pauliukonis . | |
| 4,609,130 | 9/1986 | Katva . | |
| 4,634,351 | 1/1987 | Leonard et al. . | |
| 4,741,678 | 5/1988 | Nehring . | |
| 4,750,868 | 6/1988 | Lundback . | |
| 4,830,737 | 5/1989 | Cole, Jr. | 222/61 X |
| 4,946,076 | 8/1990 | Hackmann et al. . | |
| 4,962,870 | 10/1990 | Schneider . | |
| 4,974,754 | 12/1990 | Wirz . | |
| 5,088,631 | 2/1992 | Torterotot . | |
| 5,114,047 | 5/1992 | Baron et al. . | |
| 5,125,539 | 6/1992 | Schneider . | |
| 5,261,798 | 11/1993 | Budde . | |
| 5,275,309 | 1/1994 | Baron et al. . | |
| 5,277,333 | 1/1994 | Shimano | 222/61 X |
| 5,320,250 | 6/1994 | La et al. . | |
| 5,351,862 | 10/1994 | Weag . | |

*Primary Examiner*—Gregory L. Huson
*Attorney, Agent, or Firm*—Banner & Witcoff, Ltd.

[57] ABSTRACT

A dispenser includes a viscous fluid feed cavity and dispense cavity with an intermediate passageway therebetween and a diaphragm mounted for reciprocatory movement so positioned that during the dispensing process, the movable diaphragm is moved between a first position wherein the passageway is opened, a second position to close the passageway, and a third position to affect viscous fluid dispensing through an outlet coupled to the dispensing cavity. A diaphragm position sensor is provided for determining the relative position of the movable portion of the diaphragm, the sensor being functionally coupled to the diaphragm actuator, such that the diaphragm actuator is controllable in accordance with the relative position of the diaphragm to insure accurate control of micro quantities of viscous fluid dispensed from the dispenser.

13 Claims, 3 Drawing Sheets

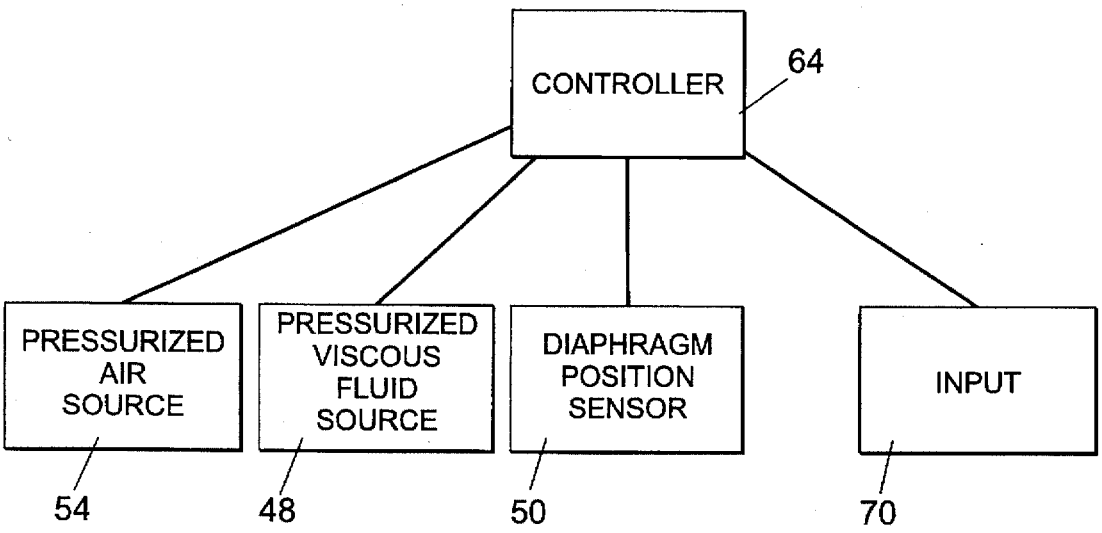
FIG. 2
FIG. 3
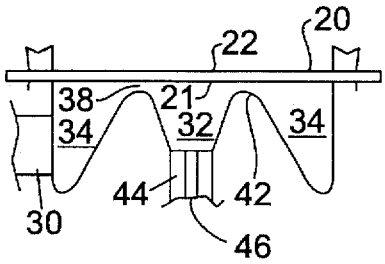
FIG. 4
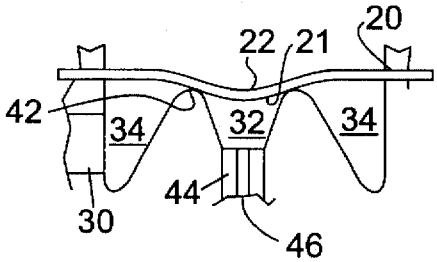
FIG. 5
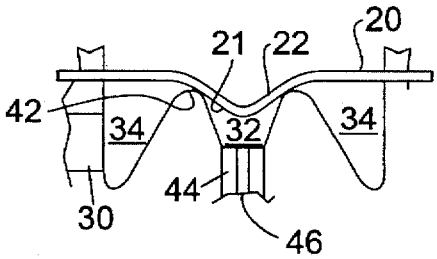

DISPENSER AND METHOD FOR DISPENSING VISCOUS FLUIDS

FIELD OF THE INVENTION

The present invention relates to a dispenser and a method for dispensing viscous fluids. More specifically, the present invention relates to a dispenser having a flexible membrane or diaphragm intended for dispensing discrete micro quantities of a viscous fluid onto a printed circuit board permitting electronic components to be subsequently affixed to the printed circuit board.

BACKGROUND OF THE INVENTION

Existing dispensers for dispensing discrete predetermined quantifies of a viscous fluid adhesive onto a printed circuit board prior to population with electronic components generally fall into two categories: (i) "air over" and (ii) "positive displacement." However, dispensers in both of these categories have not been totally satisfactory and include various drawbacks.

Air over systems use air pressure applied directly over the top of a syringe to force viscous fluid from the exit end of the syringe, i.e., the nozzle, onto the circuit board. Accordingly, air over systems are unable to reliably dispense small quantities of viscous fluid, and normally require that the dispensed viscous fluid be preheated to minimize the reliability problem by providing proper flow characteristics. In addition, the air over systems require repeated calibrations to the system due to the constantly changing volume of viscous fluid in the syringe and its effect on the dispensing dosage.

Positive displacement dispenser systems typically utilize a piston or a screw auger to force viscous fluid out of a nozzle utilizing a constant, minimum pressure to the feed viscous fluid into a chamber housing the piston or screw auger. Thus, positive displacement systems include integral and essential moving parts which are wetted by the viscous fluid and can lead to long term reliability issues, such as the binding of the moving parts, and the requirement to frequently clean the dispensing mechanism. In addition, these systems require a fairly complex, closely toleranced array of mating parts to ensure that the viscous fluid is properly dispensed. This requirement results in a higher part and assembly cost, or a reduced dispensing dosage accuracy if closely toleranced parts are not used.

Alternative positive displacement dispenser for dispensing viscous fluids, include the system in U.S. Pat. No. 5,320,250, which disclose a positive displacement piston which physically contacts a diaphragm intermittently for dispensing a viscous fluid. However, the structure of such systems present structural and operation drawbacks.

Therefore, a dispenser and a method for dispensing discrete micro quantities of viscous fluid adhesive onto a printed circuit board was needed which would eliminate the need for repeated calibrations, precise viscous fluid adhesive preheating, and the mating of wetted parts and thereby overcome the reliability problem, and permit the accurate and reliable dispensing of micro quantifies of a viscous fluid adhesive. The present invention was developed to accomplish these and other objectives.

SUMMARY OF THE INVENTION

In view of the foregoing, it is a principal object of the present invention to provide a dispenser for dispensing discrete predetermined micro quantities of a viscous fluid which does not require repeated calibrations or accurate preheating of the viscous fluid.

It is a further object of the invention to provide a dispenser for dispensing discrete predetermined micro quantities of a viscous fluid which utilizes a flexible diaphragm to ensure that no mated wetted parts are moving relative to the viscous fluid in such a way that may create unreliability of the dispenser over time.

It is another object of the invention to provide a dispenser for dispensing discrete predetermined micro quantities of a viscous fluid which facilitates the modification of the quantity of viscous fluid dispensed under program control.

It is yet another object of the invention to provide a dispenser for dispensing discrete predetermined micro quantities of a viscous fluid which utilizes a closed loop position sensor to detect the motion of a diaphragm to ensure that highly accurate, repeatable, and adjustable fluid quantities are dispensed reliably.

It is a further object of the invention to provide a method for dispensing discrete predetermined micro quantities of a viscous fluid which automatically seals a dispensing cavity and does not require a check valve mechanism to prevent the unintended escape of viscous fluid during the dispense cycle.

It is another object of the invention to provide a dispenser having a minimal amount of components for dispensing discrete predetermined micro quantifies of a viscous fluid which permits extremely quick and simple disassembly, cleaning, and reassembly.

These and other objects are achieved by the present invention which, according to one aspect, provides a dispenser for dispensing discrete predetermined micro quantities of viscous fluid. The dispenser includes a viscous fluid supply, a viscous fluid outlet, a viscous fluid passageway fluidly connecting the viscous fluid supply and the viscous fluid outlet, a diaphragm, a diaphragm actuator, and a diaphragm position sensor. The diaphragm includes a portion mounted for reciprocatory movement, a first surface, and a second surface opposed from the first surface. The first surface defines a boundary of the viscous fluid passageway such that movement of the movable portion of the diaphragm in a first direction dispenses the viscous fluid from the viscous fluid outlet. The diaphragm actuator includes a controllable pressurized actuator fluid source in fluid communication with the second surface of the diaphragm to cause the reciprocatory movement of the movable portion of the diaphragm. The diaphragm position sensor determines the relative position of the movable portion of the diaphragm, and is functionally coupled to the diaphragm actuator. This allows the diaphragm actuator to be controllable in accordance with the relative position of the movable portion of the diaphragm, and achieves the accurate control of predetermined micro quantifies of viscous fluid dispensed from the dispenser.

In another aspect, the invention provides a method for dispensing discrete micro quantities of a viscous fluid adhesive by a dispenser. The method includes the steps of providing a diaphragm with a movable portion in a first position, and supplying a pressurized viscous fluid adhesive in fluid communication with a dispensing cavity positioned adjacent the diaphragm. The movable portion of the diaphragm is moved from the first position towards a desired position which causes the dispensing of viscous fluid adhesive from a fluid outlet coupled to the dispensing cavity. The position of the movable portion of the diaphragm is sensed, and the movement of the movable portion of the diaphragm is terminated in response to a sensing that the movable portion of the diaphragm has reached a desired position.

These and other objects and features of the invention will be apparent upon consideration of the following detailed description of preferred embodiments thereof, presented in connection with the following drawings in which like reference numerals identify like elements throughout.

BRIEF DESCRIPTION OF THE DRAWINGS

FIG. 2 is a schematic block diagram of the control system of the dispenser of FIG. 1;

FIG. 3 is an enlarged cross sectional view of the diaphragm and the feed cavity of the dispenser of FIG. 1, with the diaphragm in a first position, and the diaphragm position sensor removed for clarity;

FIG. 4 is an enlarged cross sectional view similar to FIG. 3 with the diaphragm shown in a second position; and FIG. 5 is an enlarged cross sectional view similar to FIG. 3 with the diaphragm shown in a third position.

DETAILED DESCRIPTION OF THE PREFERRED EMBODIMENT

Figure 1:
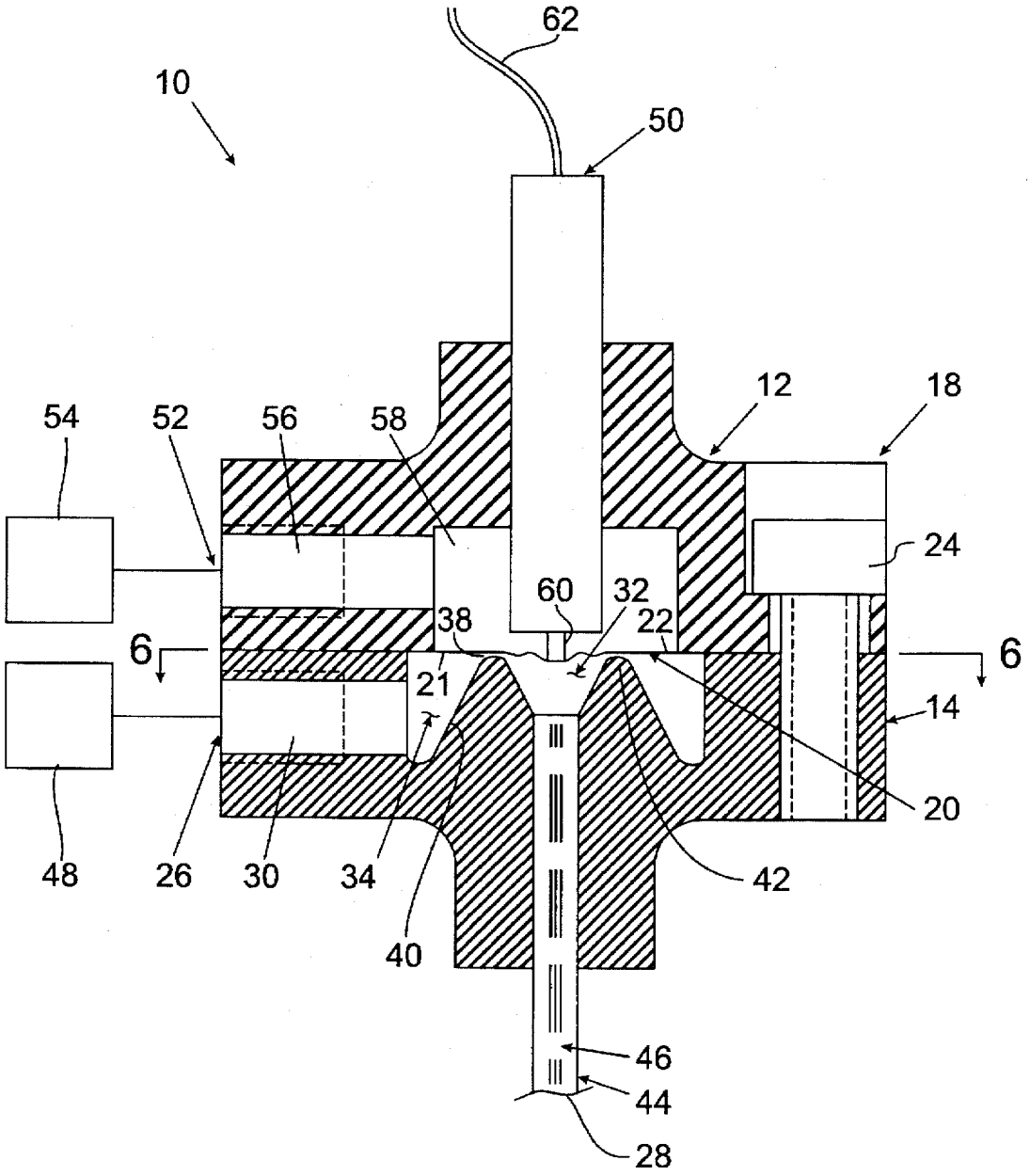
FIG. 1 is a cross sectional view of the dispenser of the present invention.

An apparatus of the present invention for dispensing discrete, variable predetermined micro quantifies of viscous fluids, the viscosity being generally in the order of or greater than fifty centipoise, is pictured in FIG. 1, and is designated by reference numeral 10. Specifically referring to FIG. 1, dispenser 10 generally includes an actuator housing 12, a fluid dispensing housing 14, and a diaphragm 20. The diaphragm 20 includes an outer or periphery portion immovably fixed between the housings 12 and 14, and an inner or center portion which is deflectable such that it moves within the housings 12 and 14 in a generally oscillatory or reciprocating manner. As will be apparent from the description below, diaphragm 20 further includes a first surface 21 which faces the inside of the dispensing housing 14, and a second surface 22, opposed from first surface 21, which faces the inside of the actuator housing 12.

Fluid dispensing housing 14 and actuator housing 12 are attached to each other by any suitable fastening arrangement, e.g., removable conventional hardware 24, in a manner which restrains movement of the outermost portions of diaphragm 20. In a preferred embodiment, actuator housing 12 of dispenser 10 is circular in plan view, and three radially spaced fasteners 24 are utilized to attach the housings 12 and 14 together.

The fluid dispensing housing 14 includes a viscous dispensing fluid passageway 30 which provides fluid communication between a controllable pressurized viscous fluid source 48 and a fluid outlet 28 of the dispenser housing 14. Pressurized viscous fluid source 48 is coupled to a fluid inlet 26 on the dispensing housing 14, and an inlet channel 30 fluidly connects the fluid inlet 26 to a centrally located feed cavity 34. The controllable pressurized fluid source 48 may be any suitable arrangement including a reservoir such as a syringe cartridge. Such devices are commercially available.

Figure 6:
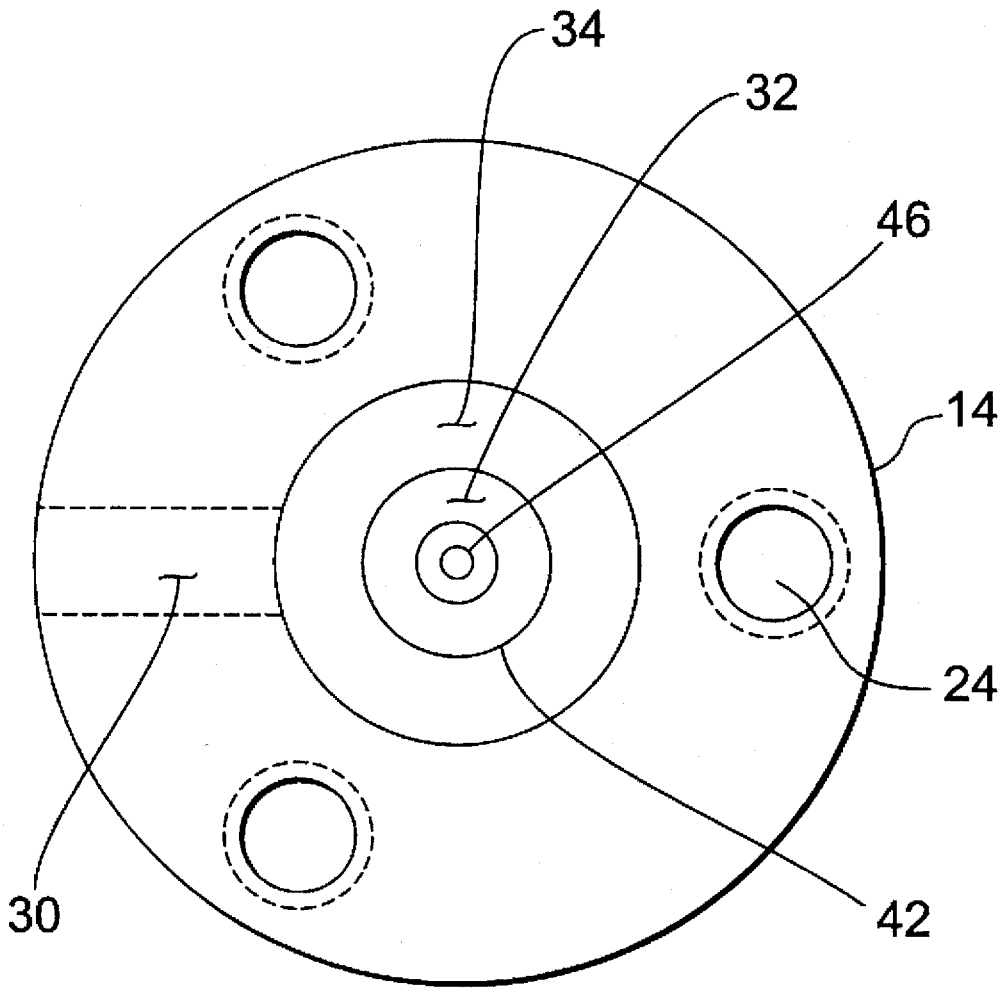
FIG. 6 is a sectional view showing the annular construction of the present invention.

As shown in FIGS. 1 and 6, dispenser housing 14 includes an annular outer feed cavity 34, an annular inner dispense cavity 32, and an annular inter-cavity dam 42 with an annular passageway 38 between dam 42 and first surface 21 of diaphragm 20. The inner dispense cavity 32 is in direct communication with the dispensing channel 46 of a nozzle 44 which includes the fluid outlet 28 at its tip.

The viscous fluid dispenser 10 is designed so that a continual reservoir of viscous fluid is available in the outer feed cavity 34 under pressure for feeding into the inner dispenser cavity 32. The shape of the inner dispenser cavity 32 is such that during actuation of the diaphragm 20, the viscous fluid is directed, via the inwardly sloping shape of the dam 42 and feed cavity 32 toward the dispensing channel 46 of the nozzle 44. Further, the shape of the outer feed cavity and dam 42 is designed such that the viscous fluid flows easily into the inner dispenser cavity 32 through passageway 38. The dam 42 is designed such that, during operation of the diaphragm 20, the inner dispenser cavity 32 is sealed and the viscous fluid is prevented from moving back into the outer feed cavity 34. In addition, pressurized viscous fluid from source 48 ensures reliable, continuous refills of the inner dispenser cavity 32 when diaphragm 20 is in its relaxed position and passageway 38 is open. It should be noted that the shape of the viscous fluid feed cavity 34, dam 42, and dispenser cavity 32 may be altered for optimal operation for a given fluid characteristic.

In addition, nozzle 44 is preferably removably coupled to the dispensing housing 14 at or near its upper end. The nozzle 44 and its dispensing channel 46 are designed in length and width to provide the correct volume of viscous fluid and ensure that adequate back pressure exists to prevent escape of the viscous fluid between dispensing cycles.

Thus, pressurized viscous fluid is introduced into the fluid inlet 26 from pressurized fluid source 48, through the connecting channel 30 to the outer feed cavity 34 of dispense housing 14. Depending upon the position of the diaphragm 20, viscous fluid may be permitted to pass from outer feed cavity 34 to inner dispense cavity 32, via intercavity passageway 38. Viscous fluid in inner dispense cavity 32 is subsequently discharged through the dispensing channel 46 of the nozzle 44 and from the fluid outlet 28.

The actuator housing 12 includes a diaphragm actuator cavity 58 and a diaphragm position sensor 50. In sum, the diaphragm actuator applies a force from a controlled pressure source 54 to move diaphragm 20 between desired positions, and diaphragm position sensor 50 senses the position of the diaphragm 20 with respect to the housings 12 and 14. The controlled pressure source 54 and diaphragm position sensor 50 permit the controlled accurate predetermined micro quantifies of viscous fluid to be dispensed from the outlet 28.

In a preferred arrangement, the diaphragm actuator cavity 58 uses pressurized air, or another suitable fluid, to apply a controlled pressure to the second surface 22 of the diaphragm 20. This causes the diaphragm 20 to move downward into the fluid dispensing cavity 32 and force viscous fluid out through fluid outlet 28. The air actuator system includes a pressurized air source 54 fluidly coupled to actuator cavity 58, via an air input port 52 and air connecting channel 56. The pressurized air in the actuator cavity 58 pushes downward on the second or actuator surface 22 of diaphragm 20, and forces the diaphragm 20 downwardly to dispense viscous material.

The pressurized air source 54 is controllable to provide precisely controlled pressurized air. In a preferred embodiment, the pressurized air source 54 can increase, decrease, or hold constant, the air pressure in actuator cavity 58. A pressurized air source is used in the preferred embodiment to move the diaphragm 20 due to its simplistic nature, light weight, and controllability.

Diaphragm 20 includes a center portion which is reciprocally movable within the range of positions between a first position in which the diaphragm 20 is substantially planar or in a relaxed position and its clearance with dam 42 forms passageway 38, as shown in FIGS. 1 and 3, and a third position in which the diaphragm 20 is at a desired stroke position and the inter-cavity passageway 38 is totally closed, as shown in FIG. 5. As shown in FIG. 4, the inter-cavity passageway 38 is closed upon the diaphragm 20 reaching an intermediate second position during its downward stroke.

In a preferred embodiment, the diaphragm 20 has an inherent or natural memory or spring force, such that it is biased into its first position, as shown in FIGS. 1 and 3. During a dispensing stroke, controlled pressure source 54 forces the diaphragm 20 to move downward against its natural biasing force. During a return stroke, the natural biasing force moves the diaphragm 20 from its third position to its first position when the biasing force exceeds the downward pressure force on the diaphragm 20 by pressure source 54. It should be noted that controlled pressure source 54 can be designed to apply a negative pressure to actuator cavity 58 to help move the diaphragm 20 to its first position.

The diaphragm 20 is designed such that it has enough flexibility and rigidity to ensure a controlled displacement during actuation. Further, diaphragm 20 provides sufficient flexibility for elastic elongation and also ensures proper contact with the dispensing cavity dam 42 to prevent the back flow of the viscous fluid. To accomplish these objectives, diaphragm 20 is preferably made of 3/1000 inch thick 303 stainless steel and diaphragm 20 can include one or more convolutions and a concave shape. It is also recognized that diaphragm 20 may be constructed in a variety of shapes, sizes, and/or materials and thicknesses to optimize operation for a given viscous fluid.

The diaphragm position sensor 50 is a device which directly, or indirectly, senses the position of the diaphragm 20, and more specifically the center portion of the diaphragm 20, to determine its relative displacement. The sensor 50 is functionally coupled to the diaphragm actuator to sense the "stroke" of the diaphragm 20 and to dispense the desired viscous fluid volume. In a preferred embodiment, sensor 50 is a linear variable displacement transducer with a displacement plunger 60 having a tip which is in contact with the second or upper surface 22 of the diaphragm 20. The sensor 50 further includes a lead 62 extending therefrom which is electrically coupled to a controller 64, as best shown in FIG. 2. It is recognized that in lieu of the sensor 50 shown and described, other types of sensors, i.e., optical sensors, or inductive displacement transducers, or any of a variety of highly accurate, sensitive displacement transducers, could be used.

Referring to FIG. 2, a controller 64 is coupled to the viscous fluid pressure supply 48, the pressurized air source 54, the diaphragm position sensor 50, and an input device 70, e.g., a keyboard. The controller 64 coordinates the operation of the devices 48 and 54, with information obtained from sensor 50, input 70, and its memory, and preferably includes well-known sequential or combination logic circuitry, a microprocessor, a programmable logic array, or other known control circuitry.

In operation, the diaphragm 20 is initially in its first position, as shown in FIGS. 1 and 3, and pressurized viscous fluid is supplied and pumped by source 48 into outer and inner cavities 34 and 32 of dispenser housing 14. The viscous fluid is preferably pumped at a low pressure until the feed cavity 32 and the dispensing channel 46 are full. However, the pressure of the fluid is set just below that which would allow the adhesive to flow freely from the outlet or nozzle tip 28.

To dispense a micro quantity of viscous fluid, diaphragm 20 is actuated by source 54. At a second position during the dispensing stroke, as shown in FIG. 4, the diaphragm 20 seals the dispensing cavity at dam 42 by closing the inter-cavity passageway 38. In addition, constant pressure is continually being applied to the entering viscous fluid adhesive to prevent escape of the viscous fluid adhesive from the outer feed cavity 34.

During the actuation process, the diaphragm position sensor 50 monitors the displacement of the diaphragm 20. When a preprogrammed third diaphragm displacement position is reached, corresponding to the desired dispensed micro quantity fluid volume, the diaphragm actuator, i.e., source 54, is switched off to cease the downward stroke of the diaphragm 20. The diaphragm 20 will start its return stroke due to its inherent biasing force. The pressure of the viscous fluid applied by the source 48 may then be momentarily raised to a higher pressure to assist in rapidly refilling the inner dispense cavity 32. However, the increased refill pressure force would then be turned off allowing only "normal low pressure" pressurization of feed cavity 34 upon the diaphragm position sensor 50 sensing that the diaphragm has reached a predetermined position.

The invention further includes other desirable attributes and advantages. The quantity and/or the shape of the micro quantities of viscous fluid which are dispensed can easily be modified in a number of ways. First, the dispensed volume can easily be changed by programming a different diaphragm displacement distance to be sensed by sensor 50 which corresponds to a desired volume, and/or programming a new actuation force applied to the diaphragm 20. This programming can easily be accomplished by use of input device 70. The micro quantity volume can also be changed by altering the design of the diaphragm, the dispensing cavity, the nozzle, or any combination thereof.

Further, it is apparent that the use of a flexible diaphragm as incorporated ensures that no mated wetted parts are moving relative to the fluid in such a way that may create unreliability of the mechanism over time. No check valve mechanism is required to prevent escape of the fluid from the dispense cavity due to the self sealing technique of the diaphragm and the dam separating the dispense and feed cavities, the use of low pressure viscous fluid application, and a predesigned back pressure within the nozzle. Also, minimal shearing action of the viscous fluid occurs during the dispensing process since there is no significant relative motion between the viscous fluid and dispensing mechanism.

Additionally, only a minimal number of pump parts are required to perform the dispensing operation. This results in disassembly, cleaning, and reassembly of the dispenser which is extremely simple and quick to perform.

In addition, the use of a "closed loop" control system using a diaphragm displacement sensor allows the dispenser to provide the accuracy, repeatability and programmable volume adjustment required for high speed dispensing.

While particular embodiments of the invention have been shown and described, it is recognized that various modifications thereof will occur to those skilled in the art. For example, while the operation of the dispenser is described with reference to depositing discrete quantities of a viscous fluid onto a printed circuit board permitting electronic components to be subsequently affixed to the printed circuit board, the dispenser may be suitably used in other applications. Therefore, the scope of the herein-described invention shall be limited solely by the claims appended hereto.

What is claimed is:

1. A dispenser for dispensing discrete predetermined micro quantities of viscous fluid, the dispenser comprising:

a viscous fluid supply for supplying pressurized viscous fluid to the dispenser;

a viscous fluid outlet for dispensing viscous fluid from the dispenser;

a viscous fluid passageway fluidly connecting said viscous fluid supply and said viscous fluid outer;

said viscous fluid passageway connecting an outer feed cavity and an inner dispense cavity, and an inter-cavity dam between said inner and outer cavities, such that during the dispensing process the viscous fluid travels from said outer cavity to the inner cavity, via said viscous fluid passageway;

a diaphragm having a first position and a portion thereof mounted for reciprocatory movement, said diaphragm having a first surface and a second surface opposed from said first surface, said first surface defining one boundary of said viscous fluid passageway such that movement of the movable portion of the diaphragm to a second position closes said passageway at said dam, and movement of said diaphragm to a third position dispenses viscous fluid from said outlet;

a diaphragm actuator imparting reciprocatory movement to the movable portion of said diaphragm, said diaphragm actuator including a controllable pressurized actuator fluid source in fluid communication with the second surface of the diaphragm to cause the reciprocatory movement of the movable portion of said diaphragm; and a diaphragm position sensor for determining the relative position of the movable portion of the diaphragm, said diaphragm position sensor being functionally coupled to the diaphragm actuator such that the diaphragm actuator is controllable in accordance with the relative position of the movable portion of the diaphragm permitting the accurate control of predetermined micro quantities of viscous fluid dispensed from the dispenser.

2. The dispenser of claim 1, said diaphragm position sensor including a linearly displaceable plunger movable along an axis disposed generally perpendicular to the first and second surfaces of the diaphragm.

3. The dispenser of claim 1, further comprising a controller coupled to said diaphragm actuator and said diaphragm position sensor, said controller controlling the diaphragm actuator in accordance with the position of the diaphragm as determined by the diaphragm position sensor.

4. The dispenser of claim 3, said viscous fluid supply including a controllable pressurized viscous fluid source, said controller further being coupled to said controllable pressurized viscous fluid source for controlling the pressure of the viscous fluid supplied to the dispenser.

5. The dispenser of claim 1, wherein the passageway includes a dam so positioned as to contact the diaphragm in the second position to close the inner and outer cavity passageway.

6. The dispenser of claim 1, said diaphragm being formed and positioned such that the movable portion of the diaphragm is biased into its first position.

7. The dispenser of claim 1, further comprising a nozzle with a dispensing channel having a first end and a second end, said first end of the nozzle being removably coupled to the dispenser adjacent the inner feed cavity, said viscous fluid outlet of the dispenser being at the second end of the nozzle.

8. A method for dispensing micro quantities of a viscous fluid by a dispenser, the method comprising the steps of:

providing a diaphragm with a movable portion in a first position;

supplying a pressurized viscous fluid in fluid communication with a dispensing cavity positioned adjacent the diaphragm;

moving the movable portion of the diaphragm from the first position towards a third position;

said diaphragm moving step includes moving the movable portion of the diaphragm from the first position to a second position to prevent viscous fluid adhesive to exit the dispensing cavity fluidly coupled to the fluid outlet, and moving the diaphragm to the third position to force viscous fluid from the dispensing cavity out of the fluid outlet;

sensing the position of the movable portion of the diaphragm; and terminating the movement of said diaphragm in response to the sensing that the movable portion of the diaphragm has reached the third position.

9. The method of claim 8, wherein said moving the movable portion of the diaphragm step includes providing pressurized fluid to a surface of the diaphragm.

10. The method of claim 8, further comprising the steps of:

returning the movable portion of the diaphragm from the third position to the first position.

11. The method of claim 8, further comprising the step of increasing the pressure of the source of a viscous fluid to said dispensing cavity in response to the sensing determining that the movable portion of the diaphragm has reached a predetermined position.

12. The method of claim 8, wherein said sensing step includes displacing a movable plunger in contact with the movable portion of the diaphragm.

13. The method of claim 8, wherein said method includes supplying and dispensing viscous fluid adhesive having a viscosity greater than fifty centipoise.

* * * * *